United States Patent [19]

Yamamoto et al.

[11] 4,206,060

[45] Jun. 3, 1980

[54] BOLT AND NUT UNIT COATED WITH LUBRICANT

[75] Inventors: Hideo Yamamoto; Toshiro Mase, both of Amagasaki; Hidehiro Mukai; Hisao Nakayama, both of Handa, all of Japan

[73] Assignees: Sumitomo Kinzoku Kogyo Kabushiki Kaisha; Umebachi Fastener Kabushiki Kaisha, both of Osaka, Japan

[21] Appl. No.: 953,519

[22] Filed: Oct. 23, 1978

[51] Int. Cl.[2] ..... C10M 3/18

[52] U.S. Cl. ..... 252/22; 85/1 C; 252/23

[58] Field of Search ..... 252/22, 23; 85/1 C; 427/418; 428/500, 469

[56] References Cited

U.S. PATENT DOCUMENTS

| | | | |
|---|---|---|---|
| 2,700,623 | 1/1955 | Hall et al. | 85/1 C |
| 3,244,625 | 4/1966 | Silwones | 85/1 C |
| 3,806,453 | 4/1974 | McDole | 252/22 |
| 4,052,323 | 10/1977 | Feneberger et al. | 252/22 |

OTHER PUBLICATIONS

Machine Designs, vol. 18, No. 11, (Nov. 1974), p. 25 and p. 41.

*Primary Examiner*—Winston A. Douglas
*Assistant Examiner*—J. V. Howard
*Attorney, Agent, or Firm*—Ladas, Parry, Von Gehr, Goldsmith & Deschamps

[57] ABSTRACT

A bolt and nut unit coated with lubricant comprising graphite and/or molybdenum disulfide, an ethylene-vinyl acetate copolymer and a fatty acid or a metallic soap thereof. This lubricant has low temperature sensitivity, and the bolt and nut unit coated therewith can be tightened precisely into position with a constant torque regardless of variations in ambient temperature and humidity.

2 Claims, 4 Drawing Figures

BOLT AND NUT UNIT COATED WITH LUBRICANT

BACKGROUND OF THE INVENTION

This invention relates to a bolt-nut-washer combination unit coated with a lubricant for keeping the torque factor of the unit constant regardless of variations of ambient temperature.

DESCRIPTION OF THE PRIOR ART

Generally, it is required to maintain both tightening torque and torque factor at constant values for keeping the axial force introduced in tightening the bolt and nut unit constant. High tensional bolts are popularly used in skeleton constructions these days, and it has been required to keep the axial force of the bolts constant for further strengthening such constructions.

In the art of bolting works of today, it is possible to tighten the bolt and nut unit to the accurate torque value owing to the improvement in precision of the tightening tools. For ensuring such optinal bolt tightening, so-called torque control bolts such as shown in FIG. 2 are now used. This bolt is so designed that its pintail 1 is broken out at the cut groove 5 when a certain prescribed tightening force is given during tightening, and this tightening is completed with breakdown of said pintail. FIG. 3 shows a condition where tightening is being performed, and FIG. 4 shows a condition where tightening was completed with cut-out of the pintail. However, the axial force introduced to the bolt varies in accordance with the torque factor. The torque factor is variable depending on the surface roughness of the bolt and nut unit, its effective diameter, dents, etc., but the most influential factor is the friction coefficient of friction between the surfaces of the bolt and nut. The most prevalent means of lubrication available so far is the treatment with a fatty acid soap or application of fat and oil after phosphate treatment.

For instance, Machine Designs, Vol. 18, No. 11 (November, 1974, issue) teaches the ways of bolt unit surface treatment with phosphate (P. 25) and Bondalube (a solution mainly composed of sodium stearate) (p. 41).

The lubricants of this kind, however, are susceptible to the ambient temperature and also change in properties with the passage of time. On the other hand, the bolt and nut units are generally used in all possible circumstances including a severe cold or hot atmosphere, so that there has been a strong request for a surface treatment which is capable of ensuring a constant torque factor regardless of the ambient temperature variations. Table 1 shows the values of torque factor on ASTM A325 UNC $\frac{3}{4}\times 1\frac{3}{4}$ bolts which were treated by a fatty acid soap after a zinc phosphate treatment.

Table 1

| °C. | Torque factor* ($\overline{K}$) | Scatter **(d) |
|---|---|---|
| −40 | 0.160 | 0.022 |
| −20 | 0.151 | 0.037 |
| 0 | 0.143 | 0.045 |
| 20 | 0.139 | 0.020 |
| 40 | 0.125 | 0.035 |
| 60 | 0.116 | 0.021 |
| 80 | 0.106 | 0.050 |

*$\overline{K} = \Sigma Ki/n$

**$d = \sqrt{\Sigma(K_1 - \overline{K})^2/n}$ wherein $\overline{K}$: mean torque factor
Ki: torque factor of individual bolts
n: number of the bolts tested
d: scatter As shown from Table 1, even when the bolts and nuts of the same dimensions are tightened to the same torque, the axial force of the bolts at 60° C. is 23% greater than that at 0° C.

SUMMARY OF THE INVENTION

An object of this invention is to provide a bolt and nut unit coated with lubricant which is not influenced from the ambient temperature and moisture.

It is another object of this invention to provide a bolt and nut unit coated with a lubricant which shows no changes in properties with the passage of time.

The most important object of this invention is to provide a bolt and nut unit coated with lunricant which is capable of maintaining the torque factor constant regardless of any variation in ambient temperature.

The lubricant of this invention is composed of graphite and/or molybdenum disulfide, an ethylene-vinyl acetate copolymer and a fatty acid or a metallic soap thereof, and the above-said objects of this invention can be accomplished by coating the bolt and nut unit with said lubricant.

DETAILED DESCRIPTION OF THE INVENTION

This invention relates to providing a bolt and nut unit coated with lubricant which is capable of maintaining the torque factor constant regardless of variations of ambient temperature and humidity and which is also invariable in properties with the passage of time. The term "bolt and nut unit" is used herein to rever to an ordinary bolt-nut-washer combination unit.

The lubricant layer formed on the surface of the bolt and nut unit according to this invention is essentially composed of graphite and/or molybdenum disulfide, an ethylene-vinyl acetate copolymer and fatty acid or a metallic soap thereof. For applying said lubricant layer on the bolt and nut unit surface, the above-said composition is dissolved in water or an organic solvent and mixed under agitation, and then the bolts and nuts are immersed in the mixed solution. They are put to use after drying.

The lubricant may be applied to the nut alone of the bolt and nut unit or to the bolt and washer of the unit. The tightening force is most affected by the friction coefficient of the threaded portion of the nut 2. It is also affected by the friction coefficient of the contact area 3 between the nut 2 and washer 4. Therefore, the bolt tightening force can be stabilized by applying the lubricant over the entire surface of the nut.

The particle size of graphite or molybdenum disulfide, which is an essential ingredient of the lubricant used in this invention, is preferably from 0.3 to 30μ because this range of particle size is most suited for effecting uniform application of the agent on the surface of the bolt and nut unit. The graphite or molybdenum disulfide with particle sizes of over 30μ is hard to disperse in the liquid, while use of said material with particle sizes of less than 0.3μ results in too small deposit on the unit surface and causes an increase of torque factor.

The ethylene-vinyl acetate copolymer use in this invention is a viscous liquid material which is commercially available as bonding agents, and such copolymer may be used in the form of an aqueous emulsion for the purpose of this invention. The blending ratio of ethylene to vinyl acetate in said copolymer is 1:1 by molar ratio and 17:83 by weight ratio. The residual monomer is less than 0.5%.

Blending of such copolymer is intended to prevent separation of graphite from the treated surface due to vibration, friction and other causes and to keep the working environment safe from contamination by the graphite powders which may otherwise be released and scattered. That is, use of said copolymer allows formation of a fast and strong coating on the treated surface.

Figure 1:
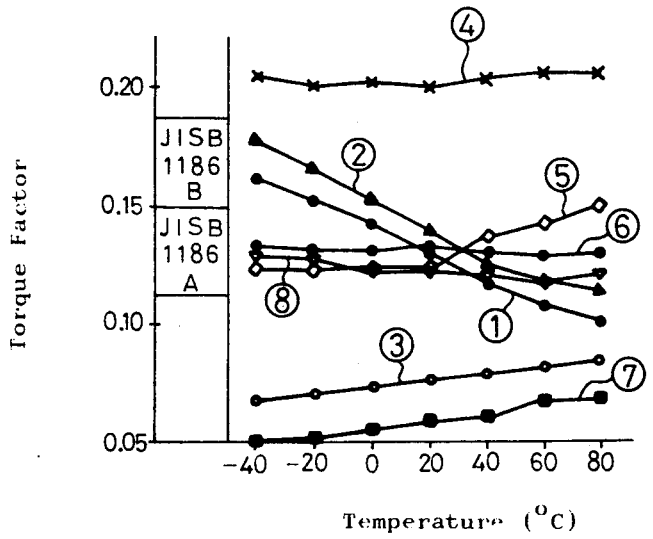
FIG. 1 illustrates the influence of ambient temperature on torque factor as determined from the results of the basic tests on the products of the present invention.
Figure 2:
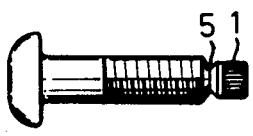
FIG. 2 shows an example of torque control bolts.
Figure 3:
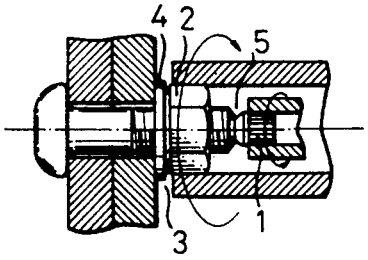
FIG. 3 shows a condition where tightening is being performed.
Figure 4:
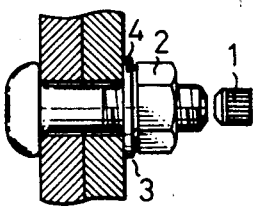
FIG. 4 shows a condition where tightening has been completed.

The reason for blending a fatty acid or a metallic soap thereof in the composition of this invention may be conveniently explained with reference to FIG. 1 showing the results of the basic tests on this invention. Curve ① in the figure represents the lubricant having the composition of Table 1, and curve ③ represents graphite with particle sizes of 5 to 6μ. In case graphite alone is used, the torque factor increases with rise of temperature, and the absolute value thereof is too low to meet the Japanese Industrial Standards (JIS). JIS 1186 in FIG. 1 specifies the bolt-nut-washer units consisting of a high tension hexagon-headed friction grip bolt, hexagon nut and flat washer which are mostly used in steel constructions, and these units are divided into two groups, A and B, according to the torque factor. Group A comprises the products in which the average value of torque factor in one production lot is from 0.110 to 0.150, and Group B comprises the products averageng in torque factor from 0.150 to 0.190. The standard deviation of the torque factor in one production lot is less than 0.010 in Group A and less than 0.013 in Group B.

Curve ⑦ represents molybdenum disulfide with particle size of 0.8 to 1.0μ. Single use of this material results in an increase of the torque factor with rise of temperature as in the case of graphite, and the absolute value thereof is even lower than that of graphite.

Single use of said ethylene-vinyl acetate copolyner in the form of an aqueous emulsion, as represented by curve ④, resultsnin an extremely high value of torque factor in independently of the ambient temperature, However, this substance has excellent surface adhesion, and use of a mixture consisting of 70% graphite and 30% resin emulsion provided the results represented by curve ⑤. Thus, although the torque factor meets the JIS requirements, it shows a sharp increase in the temperature range of from −20° to +80° C., indicating unsatisfactory adaptability. On the other hand, in the case of mineral oils or synthetic oils, the torque factor is rather lowered with rise of temperature as shown by curve ②. In view of these facts, a fatty acid with carbon number of not less than 16 or a metallic soap thereof was applied in this invention to alleviate the influence of temperature variation indicated by curve ⑤. Thus, the difficulties on curve ⑤ could be overcome by blending said fatty acid or metallic soap thereof in the composition of curve ⑤.

Examples of the fatty acids with carbon number of not less than 16 or metallic soap thereof include palmitic acid, stearic acid, oleic acid, sodium palmitate, calcium palmitate, sodium stearate, calsium stearate, sodium oleate and calcium oleate, but stearic acid or sodium stearate is most preferred for use in this invention.

Curve ⑥ represents a typical example of such composition comprising 20% graphite with particle size of 5 to 6μ, 35% ethylene-vinyl acetate copolymer and 45% sodium stearate. Curve ⑧ represents the application of a treating agent of this invention comprising 20% molybdenum disulfide with particle size of 0.8 to 1.2μ, 35% ethylenevinyl acetate copolymer and 45% sodium stearate.

The blending proportions of the ingredients, that is, graphite and/or molybdenum disulfide, ethylene-vinyl acetate copolymer and fatty acid or metallic soap thereof in the composition of this invention should preferably be selected such that the coating film obtained on the treated surface after drying would have the composition of 20–60% graphite (and/or molybdenum disulfide), 15–40% ethylenevinyl acetate copolymer and 20–60% fatty acid with carbon number of not less than 16 or metallic soap thereof.

The reasons for defining the blending proportions as said above are based on the following facts.

If the proportion of graphite and/or molybdenum disulfide is less than 20%, the torque factor of the composition becomes higher than the JIS specifications and also tends to lower with rise of temperature (Example 1, 2 and 17), while if said proportion is higher than 60%, then the torque factor becomes lower than the lower limit of the JIS specifications (Examples 5, 14 and 18). Molybdenum disulfide may be used in the same way as graphite, either singly or in combination with graphite. If the proportion of the ethylene-vinyl acetate copolymer is less than 15%, the torque factor becomes too low to meet the JIS specifications (Example 6) and also the lubricant adhesion is deteriorated to cause wide scatter in product quality due to release of the lubricant. If the proportion of said copolymer is greater than 40%, although the lubricant adhesion is good, the torque factor rises beyond the upper limit of the JIS specifications (Example 9). Less than 20% proportion of a fatty acid with carbon number of not less than 16 or a metallic soap thereof results in a too high torque factor, with such factor increasing with rise of temperature (Example 10), while more than 60% proportion of this substance causes drop of the torque factor with rise of temperature (Example 3).

As viewed above, good lubricity is provided from the compositions obtained by blending said ingredients in the following range of proportion:

| | | Most preferred range |
|---|---|---|
| Graphite and/or molybdenum disulfide | 20–60% | 30–40% |
| Ethylene-vinyl acetate copolymer | 15–40% | 20–30% |
| Fatty acid with carbon number of not less than 16 or metallic soap thereof | 20–60% | 30–45% |

These ingredients are dissolved in water or an organic solvent and mixed under agitation to obtain the treating agent of this invention. In case of using an aqueous emulsion of an ethylene-vinyl acetate copolymer as aforesaid, water may not be added. An organic solvent such as ethyl alcohol, thinner, petroleum benzine, hexane, etc., may be used instead of water.

Since the liquid such as water is dried away after the application of the coating, the amount of such liquid needn't be strictly regulated. If the liquid is used in large quantity, there may be obtained a coating with high fluidity, while if it is used in small quantity, then there may be obtained a coating with low fluidity. It is accordingly possible to obtain a coating with desirable thickness, and hence the torque factor can be adjusted to some extent by suitably regulating the coating film thickness.

In the preparation of the treating agent of this invention, it is advisable to add a dispersant such as sodium cellulose glucolate for facilitating dispersion of said ingredients. Use of such dispersand can minimize scatter of both coating film thickness and torque factor.

EXAMPLES

Shown below are the examples of this invention and the comparative examples. The lubricants shown in Table 2 and described herein below were applied to the F10 TM20×45 bolt and nut units, and after removing moisture by drying at 70° C., the torque factor was measured by a normal method. The results are shown collectively in the same table.

The lubricants used in these examples were prepared by using graphite and/or molybdenum disulfide with particle size of 5 to 6μ, a 55% aqueous dispersion of an ethylenevinyl acetate copolymer as synthetic resin and sodium stearate, and these materials were blended at the proportions shown in the table and diluted ten times with water, and the thus prepared dispersions were applied to the bolt and nut units.

Table 2

| | Lubricant composition (%) | | | | | |
|---|---|---|---|---|---|---|
| | Graphite | Molybdenum disulfide | Resin | Sodium stearate | Regression line $y = ax + b$ y: torque factor, X: temperature °C. | Judgment ( ): acceptable (X): rejected |
| 1 | 0 | — | 0 | 100 | $y = 0.1507 - 0.00070x$ | X |
| 2 | 15 | — | 40 | 45 | $y = 0.1620 - 0.00035x$ | X |
| 3 | 20 | — | 35 | 45 | $y = 0.1385 - 0.00006x$ | |
| 4 | 60 | — | 15 | 25 | $y = 0.1240 + 0.00007x$ | |
| 5 | 65 | — | 15 | 20 | $y = 0.1045 + 0.00010x$ | X |
| 6 | 45 | — | 10 | 45 | $y = 0.0990 + 0.00010x$ | X |
| 7 | 45 | — | 15 | 40 | $y = 0.1205 + 0.00005x$ | |
| 8 | 30 | — | 40 | 30 | $y = 0.1425 + 0.00006x$ | |
| 9 | 25 | — | 45 | 30 | $y = 0.1530 + 0.00020x$ | X |
| 10 | 50 | — | 35 | 15 | $y = 0.1395 + 0.00030x$ | X |
| 11 | 45 | — | 35 | 20 | $y = 0.1245 + 0.00005x$ | |
| 12 | 20 | — | 20 | 60 | $y = 0.1280 - 0.00008x$ | |
| 13 | 20 | — | 15 | 65 | $y = 0.1285 - 0.00035x$ | X |
| 14 | 100 | — | 0 | 0 | $y = 0.0835 + 0.00018x$ | X |
| 15 | 0 | — | 100 | 0 | $y = 0.2210 - 0.00008x$ | X |
| 16 | 0 | 35 | 25 | 40 | $y = 0.1235 + 0.00004x$ | |
| 17 | 0 | 15 | 40 | 45 | $y = 0.1587 - 0.00025x$ | X |
| 18 | 0 | 65 | 15 | 20 | $y = 0.1015 + 0.00018x$ | X |
| 19 | 15 | 15 | 30 | 40 | $y = 0.1225 + 0.00005x$ | |

What is claimed is:

1. A bolt-nut-washer combination unit wherein at least one of said bolt and nut is coated with a lubricant layer comprising of 20 to 60% graphite and/or molybdenum disulfide, 15 to 40% an ethylene-vinyl acetate copolymer and 20 to 60% fatty acid or a metallic soap thereof.

2. A bolt-nut-washer combination unit of claim 1, wherein the carbon number of the fatty acid or the metallic soap thereof is not less than 16.

* * * * *